United States Patent [19]

Moss

[11] 4,382,310

[45] May 10, 1983

[54] DUST MOP WITH IMPROVED BACKING

[75] Inventor: Anna M. Moss, Cleveland, Tenn.

[73] Assignee: SECO Industries, Inc., Cleveland, Tenn.

[21] Appl. No.: 307,184

[22] Filed: Sep. 30, 1981

[51] Int. Cl.[3] ..... A47L 13/253

[52] U.S. Cl. ..... 15/229 BP

[58] Field of Search ..... 15/228, 229 R, 229 A, 15/229 AC, 229 AP, 229 AW, 229 B, 229 BC, 229 BP, 229 BW, 147 R, 147 A, 147 C, 148

[56] References Cited

U.S. PATENT DOCUMENTS 3,082,456 3/1963 Short ..... 15/229 BP X 3,085,271 4/1963 Janssen ..... 15/229 BP X

*Primary Examiner*—Edward L. Roberts

*Attorney, Agent, or Firm*—Maky, Renner, Otto & Boisselle

[57] ABSTRACT

The backing for the mop has oppositely facing pockets at each end, one of which is much shorter than the other and has a cross member overlying the open inner end thereof. The cross member is secured to the backing along opposite edges thereof and is open at both ends thus permitting one end of a slip-through frame to be inserted through the cross member from the outer end thereof and into the larger pocket at the other end of the backing. The other end of the frame is then inserted into the shorter pocket by pulling the shorter pocket back from underneath the cross member and over the other end of the frame. The innermost ends of the cross member and larger pocket are spaced apart a sufficient distance to permit the folded ends of a breakdown frame to be inserted therein.

10 Claims, 5 Drawing Figures

DUST MOP WITH IMPROVED BACKING

BACKGROUND OF THE INVENTION

This invention relates generally as indicated to a dust mop with improved backing which includes provision for receipt of both a slip-through and breakdown-type mop frame.

Heretofore, it was the usual practice to provide a dust mop with a backing which would receive either a slip-through or a breakdown-type frame, but not both. Some backings are universal in the sense that they can be tied to either type of frame. However, the ties are not always as secure as one would like, in that they are always susceptible to coming undone, and such ties are also subject to wear and breakage.

SUMMARY OF THE INVENTION

With the foregoing in mind, it is the principal object of this invention to provide a dust mop with a backing which will readily accommodate both types of frames.

Another object is to provide such a dust mop with a backing that does not require the use of any flaps or ties to secure the mop to a dust mop frame.

Still another object is to provide such a dust mop with a backing of the type described which is relatively simple in construction and easy to manufacture and has a relatively long, trouble-free life.

These and other objects of the present invention may be achieved by providing the backing with oppositely facing pockets adjacent the ends thereof. One of the pockets is much shorter than the other and has a cross member overlying the open inner end thereof. The cross member is secured to the backing along opposite sides thereof and is open at both of its ends thus permitting one end of a slip-through frame to be inserted through the cross member from the outer end thereof and into the larger pocket at the other end of the backing. The other end of the frame is then inserted into the shorter pocket by pulling the shorter pocket back from underneath the cross member and over the other end of the frame.

The innermost ends of the cross member and larger pocket are generally equally spaced from the transverse center of the backing a sufficient distance also to permit the folded ends of a breakdown frame to be inserted therein. During flattening of the breakdown frame, the cross member acts as an extension of the smaller pocket, guiding one end of the frame into such pocket and providing additional support for retaining the backing on the frame.

A protective cover may be provided over the otherwise exposed center portion of the backing intermediate the cross member and larger pocket to prevent undue abrasion of the backing in that region during insertion of a breakdown frame therein.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, but one of the various ways in which the principles of the invention may be employed.

DETAILED DESCRIPTION OF THE PREFERRED EMBODIMENT

Figure 1:
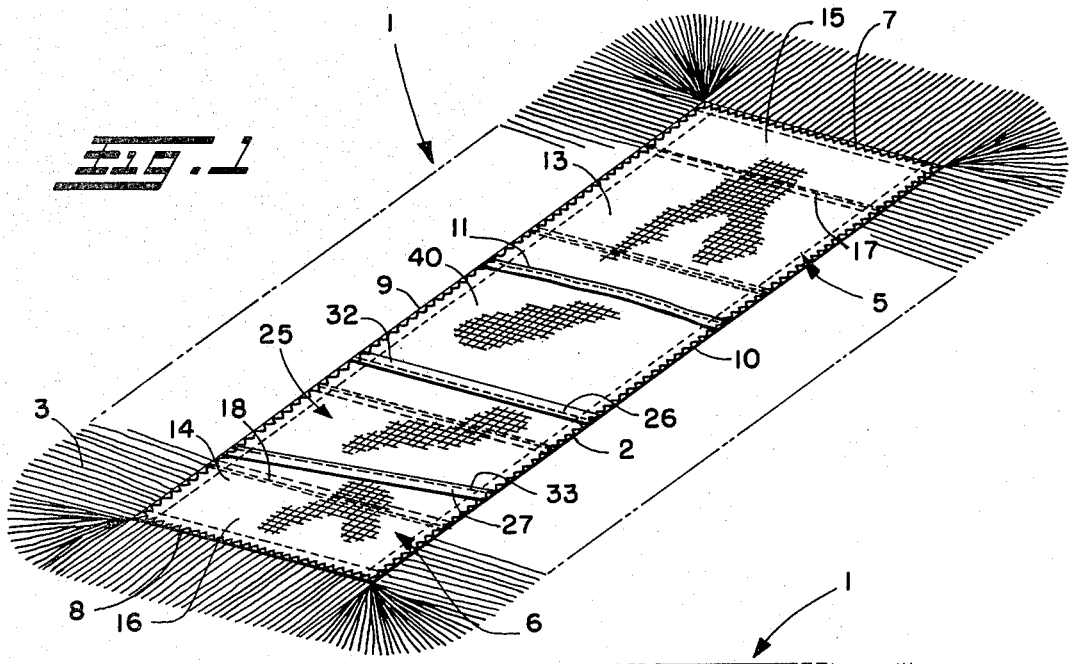
FIG. 1 is a perspective view of a dust mop including a preferred form of backing constructed in accordance with the present invention.
Figure 2:
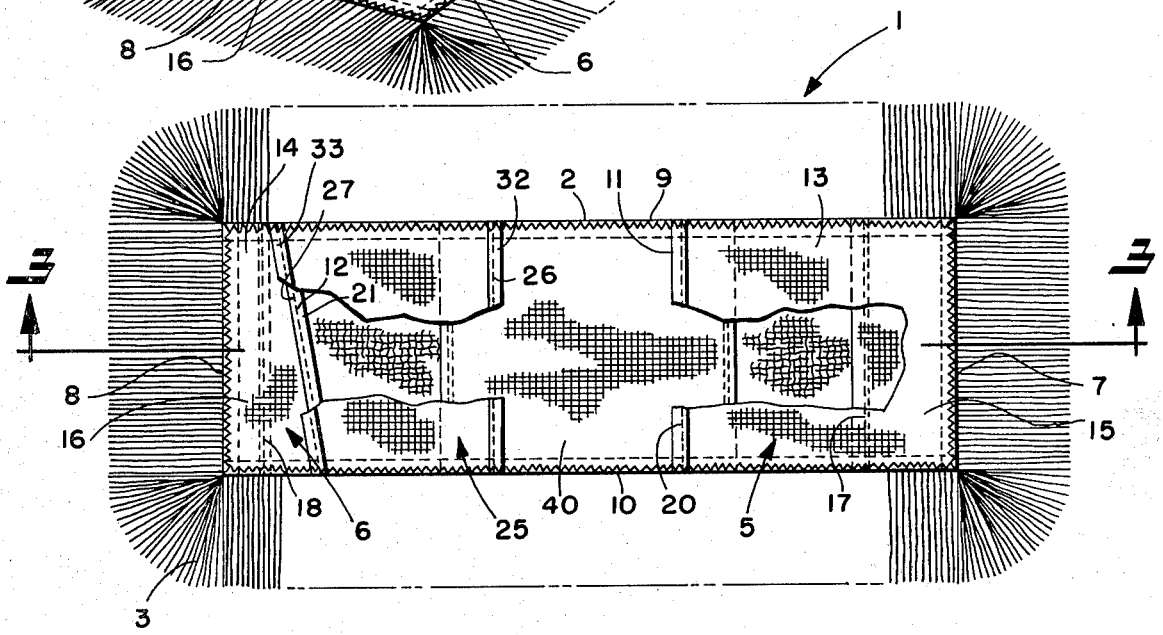
FIG. 2 is a top plan view of the backing and dust mop of FIG. 1, with portions of the backing broken away to show the disposition of the inner end of the smaller pocket beneath the outer end of the cross member and the ends of the central reinforcement extending beneath both the cross member and larger end pocket.
Figure 3:
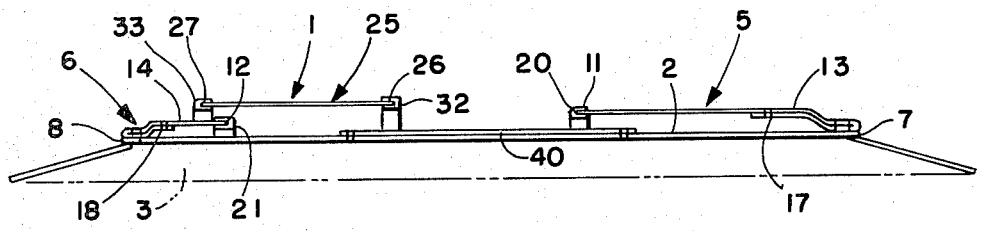
FIG. 3 is a longitudinal section through the mop of FIG. 2 taken on the plane of the line 3—3 thereof.

Referring now in detail to the drawing, and initially to FIGS. 1 through 3 thereof, there is shown a dust mop 1 including a fabric backing 2 to one side of which yarns or yarn-like material 3 are secured as by stitching or tufting. The term "yarns" as used herein is a generic term which covers all yarn and cord-like materials suitable for use in a dust mop. As described hereinafter, the backing 2 includes provision for receipt of both a slip-through and breakdown-type mop frame.

Attached to the other or back side of the backing adjacent the opposite ends thereof are a pair of oppositely facing pockets 5 and 6 formed as by stitching a single piece of fabric material to the backing across each end 7 and 8 thereof and along the sides 9 and 10 leaving the inner ends 11 and 12 of each fabric piece 13 and 14 open. The outer ends 15 and 16 of the fabric pockets are subject to the most wear, and may be reinforced by folding the outer ends of the fabric pocket material 13 and 14 underneath for a portion of the length thereof and stitching the two layers together across their width at 17 and 18 before attaching same to the backing. The outer ends and sides of the pockets may also be surged with thread to give them added strength, and reinforcing tape 20 and 21 may also be stitched to the open inner ends of the pockets.

Figure 4:
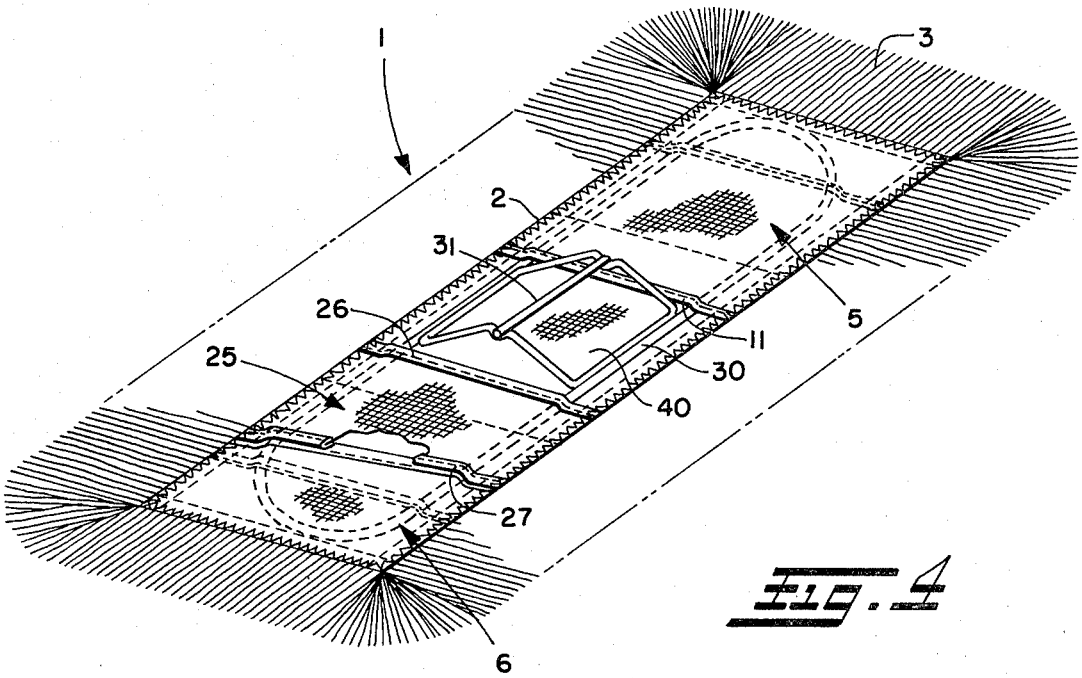
FIG. 4 is a perspective view of such mop similar to FIG. 1, but showing a slip-through frame inserted in the backing.

One of the pockets 6 is much shorter than the other one 5 and has a fabric cross member 25 overlying the open inner end thereof as shown. The cross member 25 is stitched or otherwise secured to the backing along opposite sides thereof and is open at both ends 26 and 27 thus permitting one end of a slip-through frame 30 to be inserted through the cross member 25 from the outer end 27 thereof and into the larger pocket 5 at the opposite end of the backing as shown in FIG. 4. The other end of the frame 30 is then inserted into the shorter pocket 6 as by pulling the inner end of the shorter pocket back from underneath the cross member 25 and over the other end of the frame. When thus assembled, the center frame bar 31 will be exposed between the inner ends 11 and 26 of the cross member 25 and larger pocket 5, respectively, as shown to permit attachment of a handle hinge thereto. Both sides of the cross member, like the outer ends of the pockets, may be surged with thread, and fabric tapes 32 and 33 may also be stitched to the open ends of the cross member for added strength.

The length of the smaller pocket 6 may vary somewhat, but is preferably only two to three inches long on average or otherwise it may be difficult to pull the open inner end of the pocket back over the adjacent end of the slip-through mop frame after the other end has been inserted into the larger pocket 5. Also, the open inner end 12 of the smaller pocket 6 is preferably cut on a diagonal so that the length of the smaller pocket along one side is less than along the other as shown to facilitate insertion of one end of the slip-through frame member therein and also help to retain such end within the smaller pocket. In the preferred form of dust mop shown, the shorter side of the smaller pocket has a length of approximately 1½ inches and the longer side has a length of approximately 3 inches. The outer end 27 of the outer cross member 25 also desirably extends diagonally across the backing at the same angle as the inner end of the smaller pocket and only slightly overlaps the inner end of the pocket so as not to unduly interfere with such assembly operation.

Figure 5:
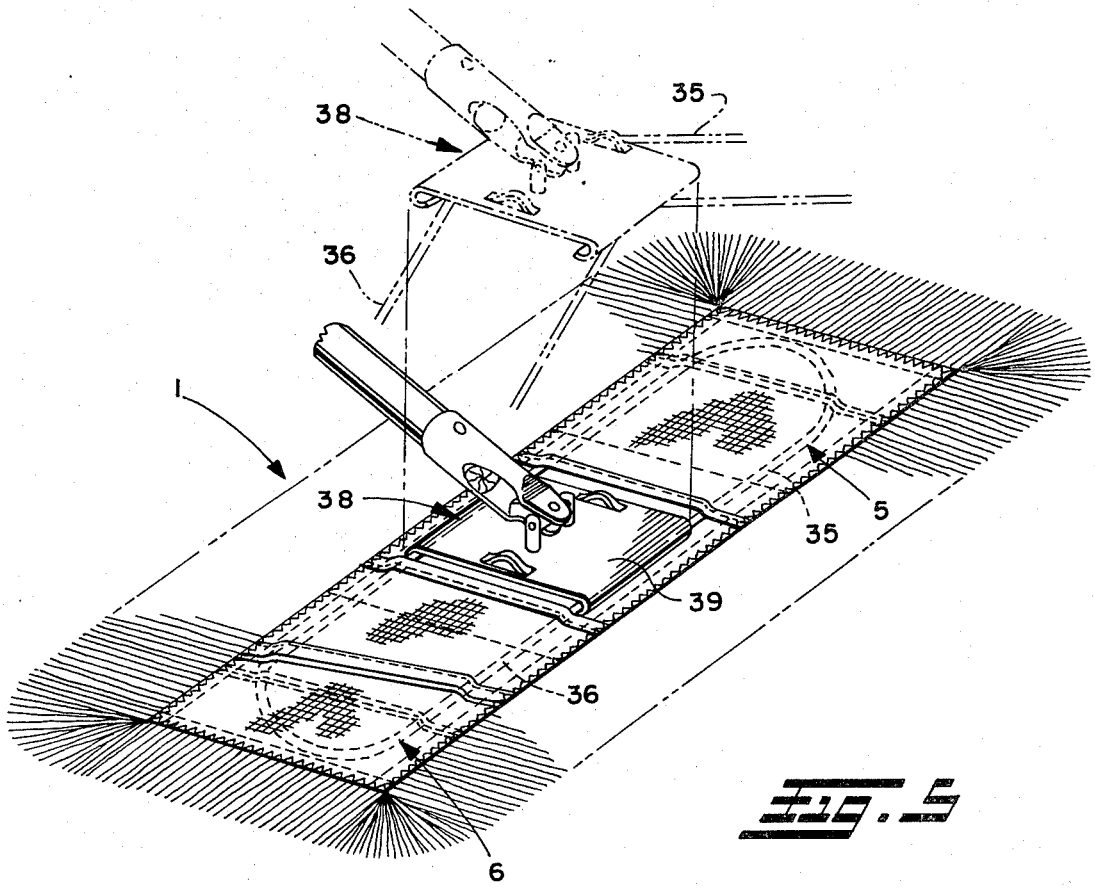
FIG. 5 is a perspective view of such mop similar to FIG. 4, but showing a breakdown frame being inserted in the backing.

The innermost ends 26 and 11 of the cross member 25 and larger pocket 5 desirably extend perpendicular to the sides of the backing and are generally equally spaced from the traverse center of the backing a distance sufficient to permit the folded ends 35 and 36 of a breakdown frame 38 to be inserted therein while the backing is folded somewhat and flattened out with the handle hinge portion 39 of the frame exposed therebetween as shown in FIG. 5. While this dimension may vary somewhat depending on the size of the breakdown frame and handle hinge, in the preferred form shown herein, the longitudinal distance between the inner ends of the cross member and larger pocket is approximately 4½ inches. During flattening of the breakdown frame, the cross member 25 acts as an extension of the smaller pocket 6, guiding one end of the frame into such pocket and providing additional support for retaining the backing on the frame.

A protective fabric covering 40 may also be provided over the center portion of the backing 2 intermediate the inner ends of the cross member 25 and larger pocket 5 to prevent undue abrasion of the backing during insertion and removal of the breakdown frame 38. Preferably, such protective fabric covering extends 1½ to 2 inches outwardly beyond the inner ends of the cross member and larger pockets and is stitched to the fabric backing around the entire periphery thereof. Also, the ends and sides of the protective fabric covering may be surged with thread for added strength.

Although different types of material may be used for the pockets and cross member as well as the protective fabric backing, a highly wear-resistant material such as nylon is preferably used. Also, such material preferably has a multitude of openings therein which have the advantage that they allow the dust mop to be washed out cleanly and dried quickly.

From the foregoing, it will now be apparent that the backing for the dust mop of the present invention provides a very simple and effective means for securely attaching the dust mop both to a slip-through or breakdown-type frame without the use of any ties or the like. Also, such backing is of a sturdy construction and should provide for a relatively long trouble-free life.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A dust mop comprising a backing having a plurality of yarns secured to one face thereof, the other face of said backing having oppositely facing pockets adjacent the ends thereof, one of said pockets being substantially shorter than the other pocket, said pockets being open at their inner ends for receipt of the ends of either a slip-through or breakdown-type mop frame, and a cross member secured to said other face of said backing along opposite sides thereof intermediate said pockets, said cross member being open at opposite ends thereof, the outer end of said cross member overlying the open inner end of said smaller pocket, and the inner ends of said cross member and larger pocket being generally equally spaced from the transverse center of said backing a sufficient distance to permit insertion of the folded ends of a breakdown frame therein.

2. The dust mop of claim 1 wherein each said pocket is made of a single piece of fabric material which is folded under at its outer end for a portion of the length thereof to provide two layers of fabric adjacent the outer end thereof which are stitched together, said pockets being stitched to said backing across each end and along both sides thereof leaving the inner ends of said pockets open.

3. The dust mop of claim 1 wherein said smaller pocket has an average length of approximately 2 to 3 inches.

4. The dust mop of claim 1 wherein the inner end of said smaller pocket extends across said backing on a diagonal whereby said smaller pocket has one side longer than the other, the shorter side of said smaller pocket being approximately 1½ inches long and the longer side being approximately 3 inches long.

5. The dust mop of claim 4 wherein the outer end of said cross member also extends across said backing on a diagonal and overlies the diagonally extending inner end of said smaller pocket, and the inner end of said cross member is substantially perpendicular to the sides of said backing.

6. The dust mop of claim 5 wherein the inner end of said larger pocket is also substantially perpendicular to the sides of said backing.

7. The dust mop of claim 6 wherein the longitudinal spacing between the inner ends of said cross member and larger pocket is approximately 4½ inches.

8. The dust mop of claim 1 wherein the inner ends of said pockets and both ends of said cross member have reinforcing tape stitched thereto.

9. The dust mop of claim 1 further comprising a protective fabric covering over the center portion of said backing intermediate the inner ends of said cross member and larger pocket, said protective fabric covering being stitched to said backing around the entire periphery thereof.

10. The dust mop of claim 9 wherein the ends of said protective fabric covering extend outwardly beyond and underneath the inner ends of said cross member and larger pocket.

* * * * *